US006826858B1

(12) United States Patent
Muller

(10) Patent No.: US 6,826,858 B1
(45) Date of Patent: Dec. 7, 2004

(54) PHOTOGRAPH AND CARD DISPLAY DEVICE

(76) Inventor: James Muller, 1125 Seymour Ave., Iowa City, IA (US) 52240

( * ) Notice: Subject to any disclaimer, the term of this patent is extended or adjusted under 35 U.S.C. 154(b) by 114 days.

(21) Appl. No.: 10/647,920

(22) Filed: Aug. 26, 2003

Related U.S. Application Data

(63) Continuation of application No. 10/064,345, filed on Jul. 3, 2002, now abandoned.

(51) Int. Cl.[7] ..... B42F 17/02; B42D 1/00
(52) U.S. Cl. ..... 40/403; 211/169; 40/376
(58) Field of Search ..... 40/376, 390, 405, 40/403; 21/169, 96, 163

(56) References Cited

U.S. PATENT DOCUMENTS

| | | | | |
|---|---|---|---|---|
| 983,439 A | | 2/1911 | Harr | |
| 2,804,212 A | | 8/1957 | Spitzig | |
| 3,017,999 A | | 1/1962 | Cano | |
| 3,599,361 A | | 8/1971 | Bowman et al. | |
| 4,426,007 A | * | 1/1984 | Beleckis et al. | 211/40 |
| 4,852,280 A | | 8/1989 | Beattie | |
| 4,901,456 A | | 2/1990 | Cotutsca | |
| 5,050,834 A | | 9/1991 | Tardiff | |
| 5,433,036 A | | 7/1995 | Ganal | |
| 5,497,889 A | | 3/1996 | Genovesi | |
| 5,833,082 A | | 11/1998 | Barthel | |
| 6,260,296 B1 | | 7/2001 | Carney, Jr. | |
| 6,394,291 B2 | | 5/2002 | Maier-Hunke | |

* cited by examiner

*Primary Examiner*—Cassandra Davis
(74) *Attorney, Agent, or Firm*—James C. Nemmers

(57) ABSTRACT

A photo display device has a mounting bracket containing a rear flat surface to which are permanently attached magnets of suitable strength to allow the device to be magnetically affixed to a smooth metal surface such as the vertical wall or door of a refrigerator. Pivotally attached to the mounting bracket are multiple transparent sleeves each adapted to receive back-to-back photographs, cards, etc. The mounting bracket is such that the user can display and view all of the images merely by pivoting the transparent sleeves.

4 Claims, 2 Drawing Sheets

PHOTOGRAPH AND CARD DISPLAY DEVICE

This application is a continuation of U.S. Ser. No. 10/064,345, filed Jul. 3, 2002, now abandoned.

BACKGROUND OF INVENTION

This invention relates to a device for displaying multiple photographs, cards, or other similar non-image items.

It is a common practice for individuals, especially homeowners, to display photographs, invitations, recipes, etc. by adhering them to the sides or doors of refrigerators, for example. The pictures are generally held on the outside of the metal housing of the refrigerator by attaching the pictures using one or more small magnets. These magnets are frequently of the type that are decorative or contain advertising. It is not uncommon for refrigerators to be almost entirely covered with pictures, notes, invitations, etc. There are known devices for holding and displaying multiple cards. For example, in Beattie U.S. Pat. No. 4,852,280, there is shown a greeting card holder and display device which has a vertically disposed central core upon which a cord is wrapped in successive loops with each "book style" greeting card inserted under the individual strands for display. Carney, Jr. U.S. Pat. No. 6,260,296 shows a photograph display device which has a multiple sided post to which are attached panel pivots so that multiple display panels can be mounted in a carousel-like fashion. However, the assembly requires fasteners to attach it to a wall or other permanent mounting place. There is therefore a need for a device that can display multiple photographs or like items on a refrigerator or other suitable surface using magnetic means so that the device can be easily removed and remounted without damage to the mounting surface.

SUMMARY OF INVENTION

The photo display device of the invention has a mounting bracket containing a rear flat surface to which are permanently attached magnets of suitable strength to allow the device to be magnetically affixed to a smooth metal surface such as the vertical wall or door of a refrigerator. Pivotally attached to the mounting bracket are multiple transparent sleeves each containing a center slot adapted to receive the photographs, cards, etc. to be displayed. The mounting bracket is such that the user can display and view all of the images merely by pivoting the transparent sleeves. The sleeves are also made to be easily removable.

DETAILED DESCRIPTION

Figure 1:
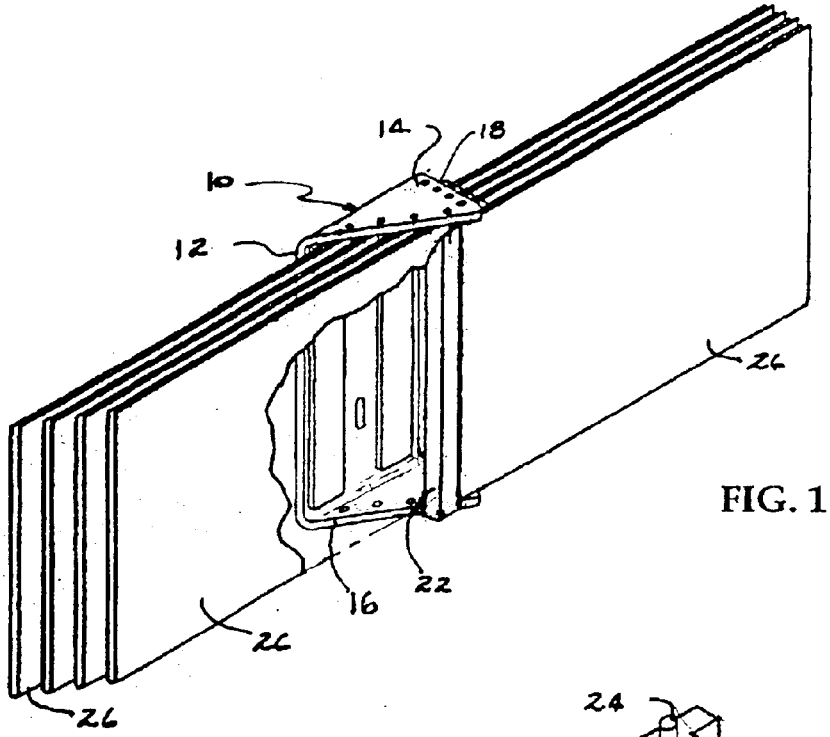
FIG. 1 is a perspective view of the device in its fully assembled condition.

Referring first to FIG. 1, which shows the fully assembled device of the invention, the device includes a mounting bracket indicated generally by the reference numeral 10. The bracket 10 has a back plate 12 that is vertically disposed when the device is in use. Extending outwardly from the back plate 12 at its upper end is a top plate 14. Similarly, extending outwardly from the lower edge of the back plate 12 is a bottom plate 16. Preferably, the back plate 12, top plate 14 and bottom plate 16 are formed as a single piece from either metal, such as aluminum, or from a rigid plastic material. If formed from plastic, mounting bracket 10 can be made from a clear and transparent material or it can be formed from a colored or decorative material either transparent or translucent. In any event, the top plate 14 preferably extends outwardly from back plat 12 and converges to form a generally triangular shaped member. Similarly, the bottom plate 16 extends outwardly and converges to form a generally triangular shaped member. From an aesthetic standpoint, the top plate 14 and bottom plate 16 are referably of substantially the same size and configuration. It will be understood however, that the top plate 14 and bottom plate 16 can be formed in a semi-circular, rectangular or other shape.

Figure 2:
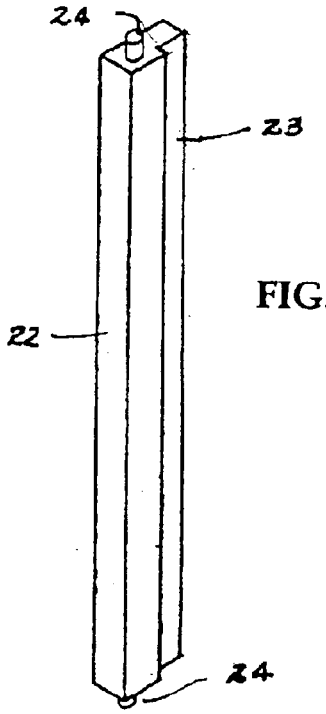
FIG. 2 is a perspective view of one of the pivot mounting members.
Figure 3:
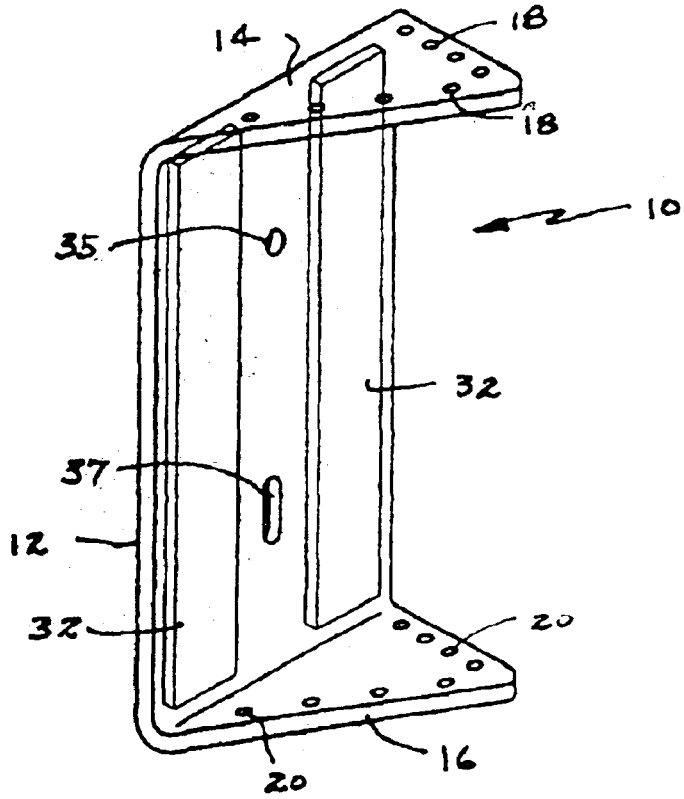
FIG. 3 is a perspective view of the mounting bracket with the display sleeves and pivot mountings removed.
Figure 4:
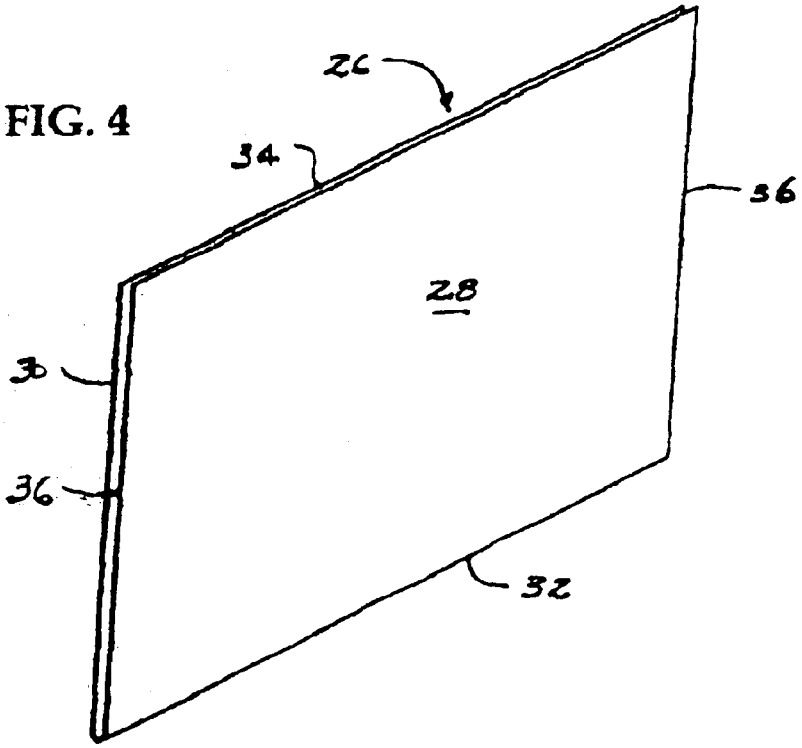
FIG. 4 is a perspective view of one of the display sleeves.

As best seen in FIG. 3, the top plate 14 is provided with a plurality of spaced apart and vertically extending openings 18. Similarly, the bottom plate 16 is provided with spaced apart and vertically extending openings 20 that correspond in vertical alignment with the openings 18 in the top plate 14. FIG. 2 shows one of the pivotal mounting members 22 which has extending from its upper and lower ends mounting pins 24. Pins 24 are received in the openings 18 and 20 of the mounting brackets 10. Each pivotal mounting member 22 is notched to form a longitudinal recess 23 that is adapted to receive a display sleeve 26 that nests in the recess 23. FIG. 4 illustrates a display sleeve 26 which has a front panel 28 and a rear panel 30 joined at their lower edges 32 to form an elongated U-shaped configuration open at the top 34 and at the sides 36. Each display sleeve 26 is suitably attached to a pivot mounting member 22 in any suitable manner such as by use of an adhesive. Other fasteners such as rivets, screws, etc. could also be used. Preferably, each display sleeve 26 is formed of a single piece of transparent plastic material, and thus provides for insertion of a photograph, card, note, or other item between the front panel 28 and rear panel 30. Since the top 34 of the display panel 26 is open and the lower edge 32 closed, the picture or other item will be securely retained in the display sleeve 26. Preferably, each display sleeve is made of a lightweight and somewhat flexible plastic so that the edges of the front panel 28 and rear panel 30 along the top 34 will be biased together to close them after a picture is inserted in the display sleeve 26. Obviously, since the front panel 28 and rear panel 30 are both transparent, a two-sided card or two cards or two pictures can be inserted back-to-back inside of the display sleeve 26 so that both of them can be viewed.

Figure 5:
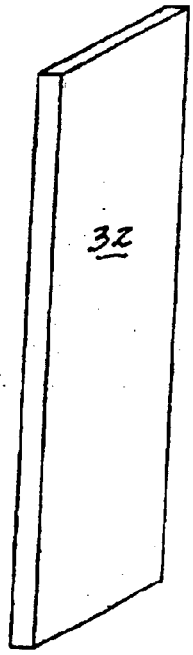
FIG. 5 is a perspective view of one of the magnetic mounting members.

In order to mount the device of the invention, there are preferably provided two magnetic strips 32, one of which is shown in FIG. 5. As best seen in FIGS. 1 and 3, the magnetic strips are attached in any suitable manner, such as by use of an adhesive, to the rear of the back plate 12. The magnets are strong enough to retain the device in place when vertically mounted on a metal surface, such as the sheet metal housing or doors of a kitchen appliance such as a refrigerator, for example. The back plate 12 may also be provided with a pair of openings 35 and 37 which can be used to receive suitable screws or other fasteners if it is desired to mount the display device on a non-magnetic surface.

Once assembled as shown in FIG. 1 with the mounting pins 24 inserted in the openings 18 and 20 and with a display sleeve attached to each mounting member 22, up to 16 pictures and be displayed in the embodiment shown in the drawings. The user can flip through the display sleeve 26 by pivoting them in order to view the various images. The device thus allows the user to view two different images at once when positioned as shown in FIG. 1 and rotate the images. If desired, the display sleeves 26 can be made so as to be removeable and reinsertable in the mounting bracket 10. This can be accomplished in a number of different ways such as by dimensioning each mounting pins 24 relative to the mounting member 22 so that it can be inserted in the mounting bracket 10 by first inserting the top pin 24 in a top opening 18 and then dropping the bottom pin 24 in the bottom opening 20 of the mounting bracket 10. Removal is easily accomplished by merely raising the display panel so as to disengage the pin 24 from the bottom opening 20. Also, if desired, each pivot pin 24 can be a long single hinge pin made of somewhat flexible material so that it can be bent to engage in and be released from the openings 18 and 20. In this version, each display panel 26 would be provided with hinge plates (not shown) similar to the common entry door hinge plates through which the longitudinal pivot pin would extend. As previously indicated, the device of the invention is useful as a handy display for not only photographs, but recipes cards, notes, invitations, reminders. When used in any one or more of these multiple uses, it can reduce clutter normally associated with such items and preventing them from becoming misplaced.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is:

1. A photograph and card display device comprising:

a mounting bracket having a back plate with a vertical mounting surface and vertically spaced apart top and bottom mounting plates each having sides extending and converging outwardly from the back plate;

the top and bottom mounting plates each have a plurality of spaced apart openings along each side thereof, the openings being at increasing distances from the back plate as the plates converge, the openings in the top mounting plate being vertically aligned with the openings in the bottom mounting plate;

pivot mounting members each having an upper end and a lower end with a vertically extending recess formed therein between the upper and lower ends;

vertically extending pivot pins extending outwardly from the upper and lower ends of each pivot mounting member, the pins being received in the vertically aligned openings in the top and bottom mounting plates;

a transparent and flexible display sleeve secured in the recess of each pivot mounting member, each display sleeve having a slot adapted to receive a photograph or card to be displayed so that a user can display and view each photograph or card merely by pivoting the display sleeves; and magnets of suitable strength affixed to the back plate to provide for attachment of the device to a magnetic surface.

2. The photograph and card display device of claim 1 in which each transparent and flexible display sleeve has a front panel and a rear panel with upper and lower edges, the lower edge of the front panel being joined to the lower edge of the rear panel to form an elongated U-shaped configuration open along the top edges of the panels so as to receive between the panels the photograph or card to be displayed.

3. The photograph and card display device of claim 2 in which the pivot pins are comprised of a flexible material that provides for flexing of the pins a sufficient amount to allow each mounting member independently to be removed and replaced between the top and bottom mounting plates.

4. The photograph and card display device of claim 2 in which the mounting members and pivot pins are dimensioned to provide for independent removal and replacement of the mounting members by first inserting the upper pivot pin into the opening in the top mounting plate and then dropping the lower pivot pin into the corresponding opening in the bottom mounting plate, removal of a mounting member being accomplished by raising the mounting member to disengage the lower pivot pin.

* * * * *